United States Patent [19]

Lema

[11] 3,935,345

[45] Jan. 27, 1976

[54] ELECTROLESS PLATING OF PEROXIDE FORMING METALS

[75] Inventor: Luis E. Lema, Milford, Mass.

[73] Assignee: Unitrode Corporation, Watertown, Mass.

[22] Filed: Aug. 20, 1974

[21] Appl. No.: 499,077

[52] U.S. Cl. ..... 427/383; 427/328; 427/437; 427/438; 427/242; 427/307; 148/6.14 R; 148/6.2

[51] Int. Cl.[2] ..... C23C 3/02

[58] Field of Search..... 148/6.2, 6.14 R; 117/50, 117/130 E, 130 R, 62; 427/328, 383, 437, 438, 307, 242

[56] References Cited

UNITED STATES PATENTS

| | | | |
|---|---|---|---|
| 2,317,205 | 4/1943 | Lowit | 148/6.14 R |
| 3,386,896 | 6/1968 | Finne | 117/50 X |
| 3,505,095 | 4/1970 | Petit et al. | 204/32 R X |
| 3,741,735 | 6/1973 | Buttle | 117/130 R |

*Primary Examiner*—Ralph S. Kendall
*Assistant Examiner*—John Douglas Smith
*Attorney, Agent, or Firm*—Weingarten, Maxham & Schurgin

[57] ABSTRACT

A method of electroless plating together with electroless plating solutions for plating the substrate of a transition metal capable of forming metal peroxides such as molybdenum or tungsten with a layer of metal plate such as chromium, cobalt, nickel or rhodium. The plating process features an oxidation and reduction reaction in which unstable surface oxides on the substrate of the transition metal are replaced by the desired metal plate. The method of the invention provides an oxygen impervious plate which protects against oxidation of the metal substrate and eliminates oxide migration as well as providing an improved metal-to-metal plate bond.

45 Claims, No Drawings

ELECTROLESS PLATING OF PEROXIDE FORMING METALS

FIELD OF THE INVENTION

This invention relates to electroless plating on a metal substrate to remove and inhibit surface oxides and in particular to a plating process for controlling oxides during the plating of transition metals such as molybdenum and tungsten.

BACKGROUND OF THE INVENTION

Transition metals such as molybdenum and tungsten and generally the metals in transition group VI of the periodic table of elements have important applications in sophisticated areas of modern technology such as high speed impeller blades in turbines and aircraft engines operating at high temperatures and in miniature electrical components. Because these metals will form surface oxides at room or elevated temperatures and because the oxides can impair the use of articles formed of these metals, it has often been necessary to encapsulate or coat such metals with a protective metal plate.

Techniques are known for plating these transition metals, but the provision of a protective metal plate is complicated by the chemically stable but physically unstable state of some of the metal oxides and the tendency of some of these chemically stable oxides to migrate to the surface if they remain in the interface between the transition metal and the metal plate. The migration of the oxides promotes further oxidation of the transition metal substrate and deterioration of the surface qualities of the plate layer as by a loss of surface smoothness or separation of the protective plate from the metal substrate. A failure of vital components formed of the plated transition metal may thereby ultimately occur.

One prior art method for coating molybdenum is disclosed in U.S. Pat. No. 3,386,896 and seeks to protect the molybdenum with a gold layer. An initial, thin gold strike is electroplated on hydrated molybdenum oxides followed by a subsequent reduction of the molybdenum oxides with hydrogen in a furnace at elevated temperatures to drive off the oxygen. Finally, a thicker gold layer is plated onto the initial layer to encapsulate the molybdenum against further oxidation. The process employs a sequential series of reaction processes that require a separate reduction of molybdenum oxides after the initial formation of a thin, electroplated gold strike and resultant exposure of the thinly plated molybdenum to the atmosphere and possible oxidation between steps.

SUMMARY OF THE INVENTION

In accordance with a preferred form of the present invention, transition metals that form metal peroxides, such as molybdenum and tungsten, are plated in a single reaction process that provides for the replacement of physically unstable surface oxides and the electroless deposition of a protective metal plate. The electroless plating reaction may be performed to provide oxidation and reduction reactions in a single solution which results in the conversion of surface oxides to a chemically stable peroxide form, and the replacement of the peroxides by atoms of the desired metal on the metal substrate. To the extent the reaction has not gone to completion because of insufficient time for the reaction or availability of reagents, metal oxides will appear in the peroxide form which does not exhibit the difficulties of the physically unstable oxides such as migration and promoting further oxidations. Such peroxides may be conveniently eliminated by an optional heat treatment without the need for further plating.

The reaction mechanism believed responsible for the elimination of unstable oxides and deposition of a protective metal plate is initiated with the hydrolysis of physically unstable molybdenum trioxides ($MoO_3$) to molybdenum hydrates ($MoO_4H_2$). The molybdenum hydrates on the surface of the molybdenum are oxidized with a peroxide to peroxymolybdates ($MoO_5H_2$ and $MoO_6H_2$) whose oxidation is coupled with the reduction of a metallic ion to provide a metal plate directly on the molybdenum. The reduction of the metallic ion by the peroxymolybdates may be simultaneous as where a single solution of metallic ions and peroxide is employed or sequential as where the molybdenum substrate is first treated with an oxidizing agent to form peroxymolybdates after which a metallic ion solution is added and reduced to a free metal plate by the peroxymolybdates. In either plating procedure, the reaction of peroxymolybdates with metal ions from a metallic ion solution on the surface of the molybdenum continues until all of the peroxymolybdates on the surface of the metal substrate are replaced or until depletion of the metallic ions or until other factors stop the reaction. In either plating procedure the unstable trioxides are controlled by their oxidation to peroxymolybdates that are either substantially or completely replaced by metal plate.

The present invention provides numerous advantages over conventional plating operations as the plated layer does not have to be as thick as required in convention operations to prevent or minimize molybdenum oxide ($MoO_3$) migration and further oxidation between the molybdenum metal and the metal plate coating. Once the electroless plating of metallic ions on the metal substrate is achieved, the whole system is generally impervious to harmful oxidation, thereby preventing the degradation of the metal substrate by oxygen and separation of the plate from the substrate. In addition, as the oxidation and reduction steps may be carried out in a single in situ plating bath, there is an elimination of the possible formation of additional harmful oxides and the numerous processing steps that have heretofore been required in the plating of peroxide forming transitional elements in group VI of the periodic table of elements.

DETAILED DESCRIPTION OF THE INVENTION

The present invention provides for the electroless plating of transition metals of group VI of the periodic table of elements that form corresponding metal peroxides so as to prevent the formation of surface oxides on the transition metal substrate that would otherwise prevent a good metal-to-metal plate bond and result in the failure of plated articles. The plating process contemplates the control and elimination of surface oxides that have heretofore remained between the transition metal and plate to migrate or otherwise impair the metal-to-plate bond.

The combination of oxide migration and oxide barrier formation between the molybdenum and the surface plate may impair the utility of a plated molybdenum article so formed. The channels resulting from oxide migration expose the molybdenum to further oxidation. The resulting loss of surface smoothness impairs the high speed performance of fluid dynamic reaction surfaces formed of molybdenum. The same oxide regions or channels may also detract from the performance of the plated molybdenum for electrical contact in electrical applications of molybdenum components.

The process together with the plating solutions of the present invention may be employed to provide a plated peroxide forming transition metal of group VI of the periodic table of elements with the elimination of harmful oxides to provide a durable metal-to-metal contact between the metal plate and the transition metal. According to this process, the surface oxides of such metals are converted to metal peroxides. Such oxidation is coupled with the reduction of metallic ions of the solution of metallic ions to deposit a metal plate on the metal substrate. An illustrative example is shown below using molybdenum as a metal substrate in which a generalized plate metal (M) is to be plated. The molybdenum to be plated is generally plated or washed in water before plating in a solution of hydrogen peroxide and plate metal ions. The simultaneous oxidation of surface oxides to peroxymolybdates coupled with the reduction of metallic ions to form a tenacious metal plate is believed to occur in accordance with the general reaction equation:

a. $MoO_3 + H_2O \rightarrow MoO_4H_2$ (hydrolysis)
b. $MoO_4 + H_2O_2 \rightarrow MoO_5H_2 + H_2O$ (yellow color)
1. $MoO_5H_2 + M^{+2} + H_2O \rightarrow M + MoO_6H_2 + 2H^+$
c. $MoO_5H_2 + H_2O_2 \rightarrow MoO_6H_2 + H_2O$ (red color)
2. $MoO_6H_2 + M^{+2} + H_2O \rightarrow M + MoO_5H_2 + O_2 + 2H^+$ Reactions *a*, *b* and *c* will continue until all the oxides are converted to peroxymolybdates ($MoO_5H_2$ and $MoO_6H_2$) with these peroxymolybdates reacting as in competing reactions 1 and 2 to reduce the metallic ions of the plating solution. The reactions are typically concluded when the evolution of gas from the plating bath is concluded and the metal substrate is protected by the metallic plate. At this point the metal oxides have been oxidized to the peroxide form and many, if not all, of these have reduced the plate metal ions to atomic depositions on the metal substrate forming an oxygen impervious coating that prevents subsequent degradation of the metal-to-metal contact and metal substrate properties. Whatever peroxymolybdates may remain do not exhibit the difficulties associated with the chemically stable but physically unstable trioxides.

As background to the above reactions, the presence of the molybdenum trioxides can generally be assumed to occur naturally on the molybdenum or other metallic surfaces in a normal atmospheric environment by reactions well known in the art. If completely unoxidized, molybdenum is initially inserted into the peroxide oxidizing solution, the trioxide form will result according to the following reactions:

$Mo + 2H_2O_2 \rightarrow 2H_2O + MoO_2$
$MoO_2 + H_2O_2 \rightarrow H_2O + MoO_3$ The existence of the peroxymolybdates ($MoO_5H_2$ and $MoO_6H_2$) in reactions b and c have been verified by the oxidation of molybdenum with peroxide and absent the metallic salt with and without ammonium hydroxide which ordinarily conceals the red color of $MoO_6H_2$ and the yellow color of $MoO_5H_2$ which for reference purposes have been included in the general plating reaction. The $MoO_5$ and $MoO_6$ oxides for the plate metal reduction reaction result from the presence of the $MoO_5H_2$ and $MoO_6H_2$ peroxides via the reversible reactions:

$MoO_5H_2 \rightleftarrows MoO_5H^- + H^+ \rightleftarrows MoO_5^{=} + 2H^+$
$MoO_6H_2 \rightleftarrows MoO_6H^- + H^+ \rightleftarrows MoO_6^{=} + 2H^+$ After the oxidation-reduction reaction has occurred and the evolution of oxygen from the plating bath has ceased, any peroxymolybdates remaining, as for example from insufficient reaction time, temperature or concentration of plating solution, may be driven off by reduction heat treatment in a hydrogen atmosphere in a furnace at about 700°C to about 1300°C. This furnace treatment, in addition to eliminating any peroxymolybdates, is useful in alloying the plate metal with the molybdenum substrate to provide a more uniform transition between the molybdenum base metal and the metal plate.

While not forming a necessary part of the process of the present invention, the surface of the molybdenum metal, preferably, is initially acid etched in a suitable acid or combination of acids such as phosphoric and/or sulfuric acid primarily to degrease and clean the substrate of oils and other surface contaminants. Also desirable, but not necessary, the etched molybdenum is washed with distilled or de-ionized water or may be quenched with ammonium hydroxide and subsequently washed. The presence of ammonia in the plating bath is undesirable as the presence of ammonia or ammonium hydroxide in the plating bath increases the rate of solubility of peroxides into aqueous medium leaving the substrate metal unprotected. After the acid etch and washing steps, the metal is immersed in the desired plating solution. The plating reaction is preferably carried out in a system that is cooled to between 0°C and 60°C with control of exothermic reactions as the formation of metal peroxides generates heat coupled with the evolution of gas. Care should be exercised in the plating reactions as the formation of $MoO_6H_2$ is carried out with the high generation of heat and oxygen which could result in an explosion of the reacting system. The reaction temperature may be controlled by any manner known in the art. A temperature of about 10°C is typical, but the process is not limited to the 0°C to 60°C range of necessity. A thermally controlled crucible or ice bath having the capacity to control the reaction in the 0°C to 60°C range is generally sufficient to control the exothermic reactions.

Plating solutions of the present invention are prepared by combining a salt of the metal desired to be plated in an aqueous solution of about 0.1 to 3 moles to and including supersaturated solutions. An oxidizing agent, such as hydrogen peroxide, is also included in the single plating solution as heretofore described. The metal substrate, up to about 0.1 $m^2$ per liter, is introduced into this electroless plating solution and allowed to remain for about 1 to 60 minutes. In particular cases the time may be less than a minute, depending upon the conditions under which the reaction is carried out. The termination of the evolution of gas typically signifies an appropriate time to consider the reaction completed. A feature of the electroless plating solutions utilized in the present invention provides the elimination of oxides by forming peroxides of the metal substrate which are capable of reducing the metallic ions of the desired plating metal from their ionic solution to deposit on the surface of the metal substrate to a desired metal plate thickness.

The following examples are given in order to illustrate the process of the present invention without intending to limit the scope of the invention:

EXAMPLE 1

Molybdenum metal having a surface area of about 30cm$^2$ was etched in a 1 to 1 volume ratio of concentrated phosphoric and sulfuric acids. The molybdenum metal was washed in de-ionized water and quenched in diluted 10 percent ammonium hydroxide solution. The molybdenum was washed in de-ionized water and then immersed in 100 mls of about 30–32 percent hydrogen peroxide solution to which 200 mls of a supersaturated solution of nickel sulfate was added to complete the plating solution. The supersaturated nickel sulfate solution was prepared by adding 500 grams of nickel sulfate per liter at 25°C. The reaction between the molybdenum base metal and the nickel plating peroxide solution was carried out at room temperature for about 10 minutes with vigorous agitation of the plating solution at which period of time the generation of small bubbles significantly decreased. The molybdenum metal was removed from the plating solution, washed and examined under a microscope which showed a thin visible deposit of the nickel plate. A test for nickel on the plated molybdenum was positive. A cross section viewed under a microscope at 400$x$ revealed the absence of the dark regions of molybdenum oxides. The deposit of nickel was subsequently enriched with an additional electroless nickel plate.

EXAMPLE 2

Chromium was electrolessly plated on molybdenum parts initially prepared as in Example 1 and thereafter the molybdenum parts were introduced into a chromium plating solution comprising 150 mls of hydrogen peroxide solution of 30–32 percent and 20 mls of chromic acid ($CrO_3$) solution. The 20 mls of chromic acid solution were taken from a stock solution of chromic acid prepared by adding 600 grams of $CrO_3$ per liter of water. As the plating reaction progressed at room temperature, 50 mls of additional hydrogen peroxide was added to the continuously agitated plating solution. After the mixture reacted for about 15 to 20 minutes the molybdenum was thereafter removed and found to have a chromium plate and the absence of harmful oxides. Due to the violent nature of the reaction at room temperature, it is suggested that subsequent reactions be carried out at about 10°C.

EXAMPLE 3

In this experiment, a nickel chromium alloy was plated by adding 20 mls of the nickel sulfate stock solution used in Example 1 to 20 mls of the chromic acid stock solution as set forth in Example 2. To this nickel sulfate-chromic acid solution about 150 mls of hydrogen peroxide (30–32 percent concentration) was used as an oxidizing agent with the molybdenum substrate being prepared as in Example 1. The molybdenum was plated for about 20 minutes at about 15°C while the plating solution was vigorously agitated after which period the evolution of gas indicated the completion of the reaction. The plated molybdenum was then examined under the microscope and the analysis of the plate and base metal showed deposits of nickel and chromium as peroxides.

EXAMPLE 4

In this example, cobalt plating solution was used for about the same area of molybdenum substrate as in Example 1 by adding 20 mls of cobalt sulfate stock solution to 50 mls of hydrogen peroxide (30–32 percent). The cobalt sulfate stock solution was prepared by adding 600 grams of cobalt sulfate per liter of water. The molybdenum substrate was prepared as in Example 1 and plated at room temperature for about 20 minutes while the plating solution was vigorously agitated and about 30 mls of peroxide were added incremently during the plating reaction. After washing and drying, cobalt deposits were found to be even and shiny on some of the molybdenum parts.

EXAMPLE 5

In this experiment, rhodium was deposited on about the same area of molybdenum substrate as in Example 1 by adding 50 mls of rhodium sulfate stock solution to 50 mls of hydrogen peroxide (30–32 percent). The rhodium sulfate stock solution was prepared by adding 100 grams of rhodium sulfate per liter of water. The molybdenum substrate was prepared as in Example 1 and plated at room temperature for about 20 minutes while the plating solution was vigorously agitated. The molybdenum showed an uneven black deposit of rhodium.

EXAMPLE 6

In this experiment, nickel was deposited on about 36 cm$^2$ area of tungsten metal. A stock solution of nickel sulfate was prepared by adding 500 grams of nickel sulfate per liter of water. The nickel plating solution was prepared by adding 200 mls of nickel sulfate stock solution as prepared in Example 1 to about 100 mls of hydrogen peroxide (30–32 percent), resulting in a plating solution having a pH of 2.3. The tungsten base metal was prepared for plating in the same manner as the molybdenum metal of Example 1. The tungsten metal was initially plated at 15°C with the temperature thereafter lowered to 12°C with the plating reaction continuing for a total time of 5 minutes at which time the evolution of gas substantially ceased. The nickel plated tungsten was examined and found to have a bright even nickel plate. The nickel plated tungsten was thereafter electroplated at 3 amperes for 20 minutes to build a thicker deposit.

The sequence of the addition of solutions and the concentration of the metallic ions of the ion to be plated are generally not critical and may be varied in particular processes to accommodate the speed of the reaction desired. The preferred embodiment of the present invention is the use of saturated solutions bearing the metallic ion of the desired metal plate and immersing the metal to be plated in a combined oxidizing solution and metal ion solution or in the oxidizing solution before the addition of the solution containing the metallic ion. This sequence of addition and concentration of solutions allows the surface of the base metal to be activated to form peroxides on the metal surface for immediate reaction with the plating solution containing the metallic ion. Also, in the preferred embodiment, the plating solution is vigorously agitated during plating thereby particularly adapting the present invention to pumping and tumbler plating operations in plating large metal pieces. A furnace treatment after the plating reaction is also preferred to remove any remaining metal peroxides.

The invention and its applications are not limited to the examples of the preferred embodiment or examples given above. The invention would appear to be useful to plate other metals of the periodic table of elements which form peroxides that may be replaced with a desired plating solution.

It will be appreciated that modifications and substitutions of the solutions and process of the present invention may be implemented by those skilled in the art to suit particular requirements which are within the scope of this invention. The scope of the invention is to be limited only as shown in the claims below.

What is claimed is:

1. An oxidation-reduction process for electroless plating of a peroxide forming transition base metal selected from Group VI of the periodic table of elements comprising the steps of:

a. oxidizing oxides on the surface of said peroxide forming metal with hydrogen peroxide to produce metal peroxides of said peroxide forming metal; and b. reducing in solution ions of a metal plating solution with said metal peroxides to deposit a protective metal plate on said peroxide forming metal;

c. said ions including ions selected from the group consisting of nickel, chromium, cobalt, rhodium or combinations thereof.

2. The process of claim 1 wherein the formation of the metal peroxides and the reduction of said peroxides to ions of the plate metal occurs in a single plating solution.

3. The process of claim 1 further comprising the steps of agitating the solution containing the ions of the plate metal during said deposit of a protective metal plate on said peroxide forming metal.

4. The process of claim 1 further comprising the steps of alloying said base metal with the reduced plate metal by heating.

5. The process of claim 4 wherein the heating is performed in a reducing atmosphere.

6. The process of claim 5 wherein said reducing atmosphere is hydrogen.

7. The process of claim 1 wherein said peroxide forming metal is molybdenum.

8. The process of claim 1 wherein said peroxide forming metal is tungsten and wherein said metal plating solution includes metal ions selected from the group consisting of nickel, chromium, cobalt, rhodium or combinations thereof.

9. A process for electroless plating of a peroxide forming transition metal of group VI of the periodic table of elements by eliminating physically unstable oxides and depositing a metal plate in an oxidation-reduction reaction comprising:

a. oxidizing oxides on the surface of said peroxide forming metal with hydrogen peroxide to form metal peroxides of said peroxide forming metal;

b. reducing metal ions of a reducible metallic ion solution with said corresponding transition metal peroxides, said ions including ions selected from the group consisting of nickel, chromium, cobalt, rhodium or combinations thereof;

c. depositing a metal plate from said reducible metallic ion solution on the surface of said peroxide forming metal; and d. heating the placed peroxide forming metal to alloy said plate to the surface of said peroxide forming metal.

10. The process of claim 9 wherein the steps of oxidizing oxides on the surface of said transition metal, reducing metal ions of a reducible metallic ion solution and depositing free metal are performed in a single plating solution.

11. The process of claim 9 further comprising the steps of hydrolyzing said physically unstable oxides in water to form corresponding metal hydrates before oxidizing said hydrates to corresponding metal peroxides.

12. The process of claim 9 wherein said heating is accomplished in a hydrogen atmosphere.

13. The process of claim 9 further comprising the vigorous agitation of the plating solution during the deposition of a metal plate on the surface of said peroxide forming metal.

14. The process of claim 9 wherein said transition metal of group VI is molybdenum.

15. The process of claim 9 wherein said transition metal of group VI is tungten.

16. A process for electroless plating of molybdenum by eliminating physically unstable oxides and depositing a metal plate in an oxidation-reduction reaction comprising the steps of:

a. oxidizing molybdenum oxides with hydrogen peroxide to form corresponding molybdenum peroxides;

b. reducing metal ions of a reducible metallic ion solution with said molybdenum peroxides, said ions including ions selected from the group consisting of nickel, chromium, cobalt, rhodium or combinations thereof;

c. depositing a metal plate from said metallic ion solution on said molybdenum; and d. alloying said deposit of metal plate to said molybdenum by heat treatment of said plated molybdenum in a furnace.

17. The process of claim 16 further comprising the steps of hydrolyzing said physically unstable oxides in water to form corresponding molybdenum hydrates before oxidizing said hydrates to corresponding metal peroxides.

18. The process of claim 16 further comprising the agitation of said metallic ion solution during said deposition of metal plate on the surface of said molybdenum.

19. The process of claim 18 wherein said agitation of said metallic ion solution is provided by a plate tumbling process.

20. The process of claim 16 wherein the steps of oxidizing said molybdenum oxides and reducing metal ions of a reducible metallic ion solution is performed in a single plating solution.

21. The process of claim 16 wherein said hydrogen peroxide is 30–32 percent peroxide.

22. The process of claim 16 wherein said reducible metallic ion solution is selected from the group consisting of nickel sulfate, chromic acid, cobalt sulfate, rhodium sulfate or combinations thereof.

23. The process of claim 16 wherein said reducible metallic ion solution is a supersaturated solution.

24. The process of claim 16 further comprising the steps of maintaining the temperature of said metallic ion solution in a range of about 0° to about 60°C during the step of depositing metal plate from said solution.

25. The process of claim 16 wherein said alloying step is performed in an atmosphere of hydrogen.

26. A process for electroless deposition of a metal on molybdenum and simultaneously eliminating physically unstable oxides in an oxidation-reduction reaction comprising:

a. removing surface impurities to provide improved plating qualities to the surface of the molybdenum metal;
b. hydrolyzing the surface of the molybdenum metal in water;
c. oxidizing said hydrolyzed molybdenum metal with a solution of hydrogen peroxide to form molybdenum peroxides;
d. reducing a reducible metal plating solution with said molybdenum peroxides during which step metal plate from said reducible metal plating solution is deposited on the surface of said molybdenum, the metal plate of said metal plating solution including metals selected from the group consisting of nickel, chromium, cobalt, rhodium or combinations thereof; and
e. heating the plated molybdenum in a reducing atmosphere to alloy said deposition of free metal to said molybdenum.

27. The process of claim 26 further comprising agitating the plating solution during the depositing of metal on the surface of said molybdenum.

28. The process of claim 26 wherein the steps of oxidizing said hydrolyzed molybdenum metal and reducing a reducible metal plating solution is performed in a single plating solution.

29. The process of claim 26 wherein said hydrogen peroxide solution is about 30–32 percent peroxide.

30. The process of claim 26 wherein said reducible plating solution is a solution of at least one metal solution selected from a group consisting of nickel sulfate, chromic acid, cobalt sulfate, rhodium sulfate or mixtures thereof.

31. The process of claim 26 wherein said metal plating solution is about 0.1 mole to a supersaturated solution.

32. The process of claim 26 wherein additional incremental amounts of hydrogen peroxide is added during the deposition of metal from said reducible metal plating solution on the surface of said molybdenum.

33. The process of claim 26 wherein the step of removing surface impurities is performed by etching said molybdenum in a one to one volume ratio of phosphoric and sulfuric acids.

34. The process of claim 26 wherein said heating is in a furnace at about 700°C to about 1300°C to alloy said deposition of metal plate to said molybdenum.

35. The process of claim 34 wherein said heating is in a hydrogen atmosphere.

36. A process for the electroless deposition of a metal on tungsten and simultaneously eliminating physically unstable oxides on an oxidation-reduction reaction comprising the steps of:
a. oxidizing tungsten oxides with hydrogen peroxide to form corresponding tungsten peroxides;
b. reducing a reducible metal plating solution with said tungsten peroxides during which step metal plate from said metal plating solution is deposited on the surface of said tungsten, said metal plating solution including metal ions, selected from the group consisting of nickel, chromium, cobalt, rhodium and combinations thereof; and
c. alloying said deposit of metal plate to said tungsten by heating said plated tungsten in a furnace.

37. The process of claim 36 further comprising the steps of agitating the plating solution during the deposition of metal plate on the surface of said tungsten.

38. The process of claim 36 wherein the steps of oxidizing said tungsten oxides and reducing a reducible metal plating solution is performed in a single plating solution.

39. The process of claim 36 wherein said reducible metal plating solution is a solution of at least one metal solution selected from a group consisting of nickel sulfate, chromic acid, cobalt sulfate, rhodium sulfate or combinations thereof.

40. The process of claim 36 wherein said metal plating solution is about 0.1 mole to a supersaturated solution.

41. The process of claim 36 wherein said metal plating solution is nickel sulfate.

42. The process of claim 36 wherein said alloying is performed in a furnace at about 700°C to about 1300°C to alloy said deposition of metal plate to said tungsten.

43. The process of claim 42 wherein said alloying is performed in a hydrogen atmosphere.

44. The process of claim 36 further comprising maintaining the temperature of said metal plating solution in a range of about 0°C to about 60°C during the step of depositing metal plate from said metal plating solution.

45. The process of claim 36 further comprising agitating said plating solution during the deposition of metal plate from said metal plating solution to the surface of said tungsten.

* * * * *